US006515625B1

(12) United States Patent
Johnson

(10) Patent No.: US 6,515,625 B1
(45) Date of Patent: Feb. 4, 2003

(54) ANTENNA

(75) Inventor: Alan Johnson, Surrey (GB)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

(21) Appl. No.: 09/568,364

(22) Filed: May 10, 2000

(30) Foreign Application Priority Data

May 11, 1999 (GB) ..... 9910857

(51) Int. Cl.[7] ..... H01Q 1/38

(52) U.S. Cl. ..... 343/700 MS; 343/846; 343/702

(58) Field of Search ..... 343/700 MS, 702, 343/846, 848; H01Q 1/38

(56) References Cited

U.S. PATENT DOCUMENTS

| | | | | |
|---|---|---|---|---|
| 5,561,435 A | | 10/1996 | Nalbandian et al. | 343/700 MS |
| 6,034,636 A | * | 3/2000 | Saitoh | 343/700 MS |
| 6,140,969 A | * | 10/2000 | Lindenmeier et al. | 343/700 MS |

FOREIGN PATENT DOCUMENTS

| | | |
|---|---|---|
| DE | 42 38 585 A1 | 5/1994 |
| EP | 0630069 A1 | 12/1994 |
| EP | 0 634 806 A1 | 1/1995 |
| GB | 2 316 540 A | 2/1998 |
| GB | 2337859 | 12/1999 |
| JP | 9-307344 | 11/1997 |
| JP | 10-28013 | 1/1998 |
| WO | WO 98/44588 | 10/1998 |

* cited by examiner

*Primary Examiner*—Hoanganh Le
(74) *Attorney, Agent, or Firm*—Perman & Green, LLP

(57) ABSTRACT

An antenna comprising an electrical reference plane; a planar conductive element, the electrical reference plane and planar conductive element being electrically coupled via a first coupling means to define a first antenna resonant frequency; and a second coupling means arranged to provide a high impedance path between the electrical reference plane and the planar conductive element at the first resonant frequency and a lower impedance path between the electrical reference plane and planar conductive element at a second frequency to define a second antenna resonant frequency.

13 Claims, 2 Drawing Sheets

ANTENNA

BACKGROUND OF THE INVENTION

This invention relates to an antenna, and in particular a dual resonance antenna.

With the increasing demand for mobile communications different cellular standards have been developed, many of which operate at different frequencies. For example, the global system for mobile communication (GSM) standard defines the primary frequency band for GSM as being from 890 MHz to 960 MHz, while the digital cellular system (DCS) standard defines the primary frequency band for DCS as being from 1710 MHz to 1880 MHz.

The different cellular systems can operate in isolation or together. To maximise the use of these different cellular systems and increase the use and mobility of mobile communication devices it is desirable for mobile communication devices to be able to roam between the different cellular systems.

To allow a mobile communication device to roam between cellular systems having different operating frequencies the communication device will typically need a dual resonance antenna with one resonating element tuned to one cellular system and a second resonating element tuned to another cellular system. The dual resonance antenna, otherwise known as a dual band antenna, may be in the form of two physically separate antenna housings having separate resonating elements that are fed via the antenna feed. Alternatively, the antenna may have two resonating elements physically coupled in the same housing, with each element having a different resonant frequency.

However, as electronic and communications technologies have advanced, there has been a drive to increase the performance and decrease the size of consumer devices. In particular, in the field of mobile communications, there has been continual demand for increasingly smaller communications devices, such as telephones, computers and personal organisers, but without a decrease in performance. However, as electronic equipment has rapidly reduced in physical size due to the development of integrated circuits, the antenna for communication equipment still remains large compared with the equipment itself.

From the point of view of facilitating the operation of mobile communication devices low profile antennae suitable for mounting within a communication device have become increasingly popular. An example of such an antenna is a planar inverted antenna where coupling the resonating element to a ground plane to produce a planar inverted F antenna (PIFA) can halve the length of the resonating element.

A PIFA comprises a flat conductive sheet supported a height above a reference voltage plane such as a ground plane. The sheet is typically separated from the reference voltage plane by a dielectric, for example air. A corner of the sheet is coupled to the ground via a grounding stub, otherwise known as a shorting pin, and a feed is coupled to the flat sheet near the grounded corner for driving the antenna. The feed may comprise the inner conductor of a coaxial line. The outer conductor of the coaxial line terminates on and is coupled to the ground plane. The inner conductor extends through the ground plane, through the dielectric (if present) and to the radiating sheet. The PIFA forms a resonant circuit having a capacitance and inductance per unit length. The feed point is positioned on the sheet a distance from the shorting pin such that the impedance of the antenna at that point matches the output impedance of the feed line, which is typically 50 ohms. The main mode of resonance for the PIFA is between the short circuit and the open circuit edge. Thus the resonant frequency supported by the PIFA is dependent on the length of the sides of the sheet and to a lesser extent the distance and the thickness of the sheet.

However, a dual band PIFA antenna having two resonating elements still increases the size of the antenna thus compromising the ability of the antenna to be mounted within a communication device.

SUMMARY OF THE INVENTION

In accordance with an aspect of the present invention there is provided an antenna comprising an electrical reference plane; a planar conductive element, the electrical reference plane and planar conductive element being electrically coupled via a first coupling means to define a first antenna resonant frequency; and a second coupling means arranged to provide a high impedance path between the electrical reference plane and the planar conductive element at the first antenna resonant frequency and a lower impedance path between the electrical reference plane and planar conductive element at a second frequency to define a second antenna resonant frequency.

This provides the advantage of a dual band antenna having a smaller size than a conventional low profile dual resonance antenna.

The overall electrical length of the planar conductive element determines the antenna's resonant frequency. When the planar conductive element, otherwise know as a resonator element, has a single coupling to the reference plane the electrical length, and hence resonance, is determined by the length and width of the resonator element with respect to the coupling. When the resonating element has a second coupling to the reference plane the electrical length is determined by the width of the element and the distance between the two coupling points. Thus a single resonator element can have a number of different electrical lengths depending on how the element is electrically coupled to the electrical reference plane.

Further, the first resonant frequency can be tuned by varying the length of the resonator element while the second resonant frequency can be tuned by altering the position of the coupling of the second coupling means to the resonator element. Thereby, the present invention provides the advantage of allowing the first and second resonant frequencies to be tuned substantially independently.

Generally the antenna includes a feed section comprising the first coupling means and a conducting element arranged parallel to each other with the conducting element being connected to a feed such that the first coupling means and the conducting element form a transmission line.

Since the feed section is arranged as a transmission line, energy is contained and guided between the conductors of the transmission line. This results in a low Q factor and hence a higher impedance bandwidth for the first resonant frequency compared with conventionally fed planar antennas. Thus, the bandwidth is increased considerably while retaining the efficiency, size and ease of manufacture of planar antennas.

Suitably, the second coupling means comprises a filter.

By using a filter which has a high impedance at the first resonant frequency and a low impedance at the second resonant frequency the planar conductive element can have two resonant frequencies simultaneously.

Preferably, the second coupling means comprises a switch movable between a first position for electrically isolating the electrical reference plane and planar conductive element and a second position for electrically coupling the electrical reference plane and planar conductive element.

BRIEF DESCRIPTION OF THE DRAWINGS

The invention will now be described, by way of example only, with reference to the accompanying drawings, in which.

DETAILED DESCRIPTION OF THE INVENTION

Figure 1:
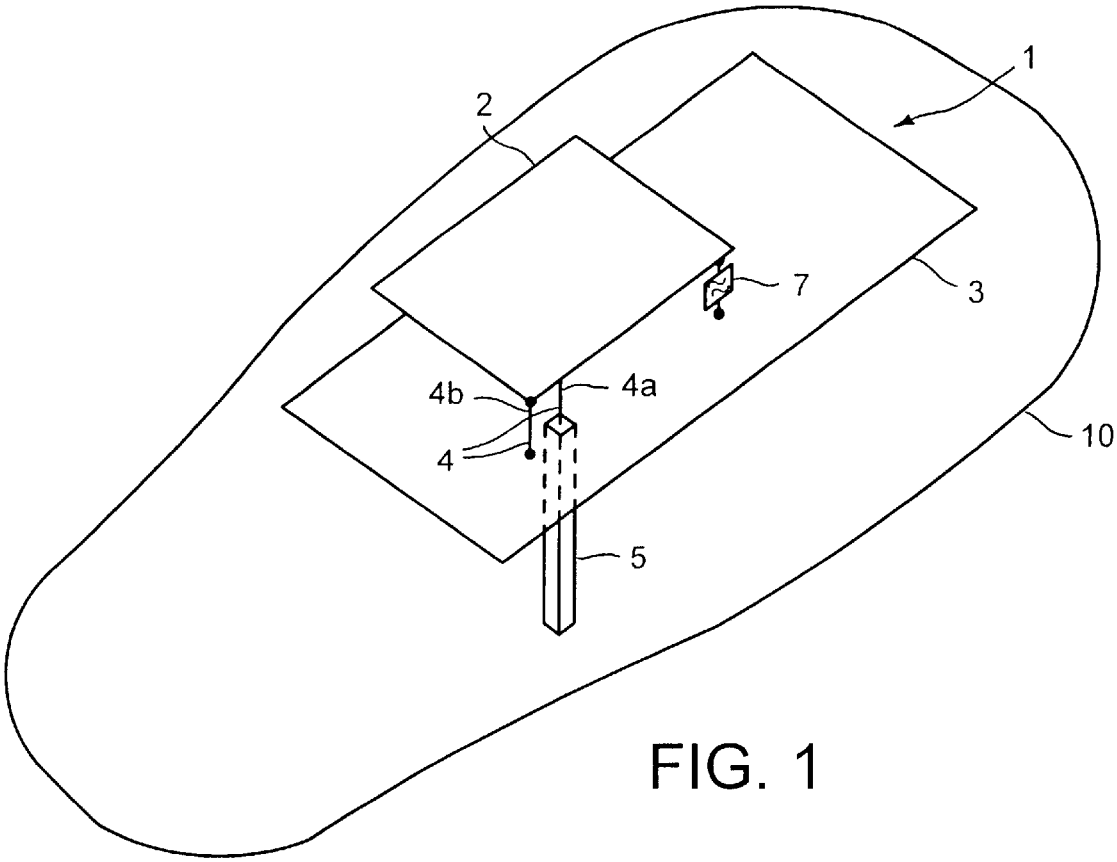
FIG. 1 shows an antenna according to a first embodiment of the present invention.

In a first embodiment, shown in FIG. 1, is a radiotelephone 10 having an antenna 1. The antenna 1 comprises a planar conductive element 2, otherwise known as a resonator element, disposed opposite an electrical reference plane 3, commonly a ground plane. A feed section 4 provides both the feed 4*a* to drive the resonator element 2 and a first coupling means 4*b* for coupling the resonator element 2 to the ground plane 3. The first coupling means 4*b* in this embodiment comprises a planar coupling strip. The feed 4*a* is coupled to transmission line 5 which conducts a received and/or transmitted RF signal between the feed 4*a* and a transceiver (not shown).

The feed 4*a* and planar coupling strip 4*b* are positioned in parallel to form a transmission line as described in GB patent application 9811669.

The coupling point of the planar coupling strip 4*b* to the resonator element 2 defines an electrical point A on the resonator element 2, which acts as a first current source. The electrical point A defines an electrical edge on the resonator element from which the electrical length of the resonator element 2 is defined.

Figure 2:
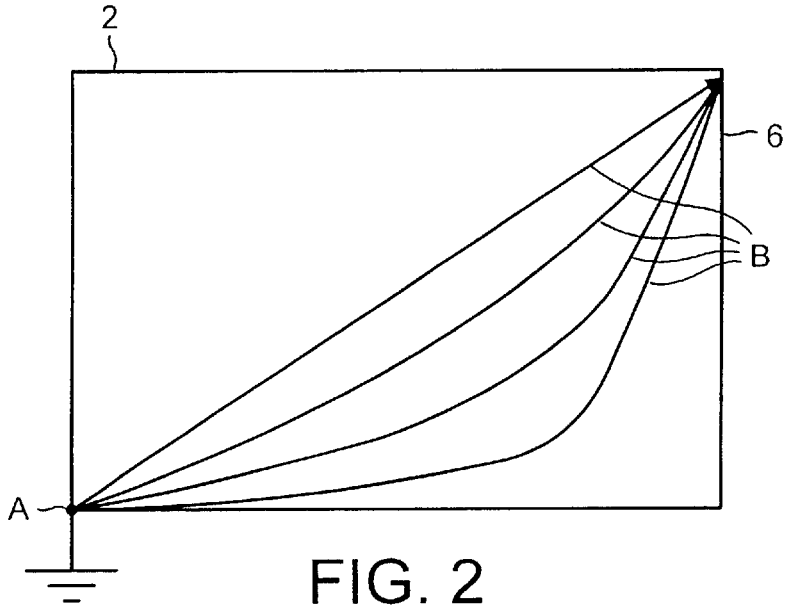
FIG. 2 illustrates the current flow for an antenna according to the present invention when operating at a first resonant frequency.

The electrical length of the resonant circuit determines the resonant frequency of the antenna. Therefore, when resonator element 2 is coupled to ground plane 3 solely by the planar strip 4*b* the electrical length of the resonator element 2 extends from the open circuit on an edge 6 of the resonator element 2 to point A (otherwise known as grounding point A) at which the planar strip meets the resonator element. FIG. 2 illustrates typical current flows B in the resonator element when resonating at the first resonant frequency.

As would be appreciated by a person skilled in the art variations in the width of resonator element 2 can also result in variations in resonant frequency and bandwidth of the antenna 1.

The portion of the feed section 4 adjacent the ground plane 3 has an impedance which matches the impedance of the line of the ground plane (typically 50 ohms). The portion of the feed section 4 adjacent the resonator element 2 has an impedance which matches the impedance at the feed point of the resonator element 2, typically of the order of 200 ohms. The impedance varies along the length of the feed section 4 in a uniform manner.

The resonator element 2 is also coupled to the ground plane 3 via filter 7. The filter characteristics are chosen so filter 7 acts as a high impedance path at the resonant frequency of the resonator element 2 as determined by the electrical length of the resonator element as described above (i.e. a first resonance frequency). This may, for example, correspond to the GSM frequency range centered around 925 MHz. The impedance of the filter 7 in this frequency range will generally be greater than 5000 ohms.

The filter 7 is also chosen to have a lower impedance, typically less than 5 ohms, at a higher frequency (i.e. at the required second frequency), for example 1795 MHz for the DCS standard. This provides a second grounding point C on the resonator element when the resonator element is required to resonate at this higher frequency.

Figure 3:
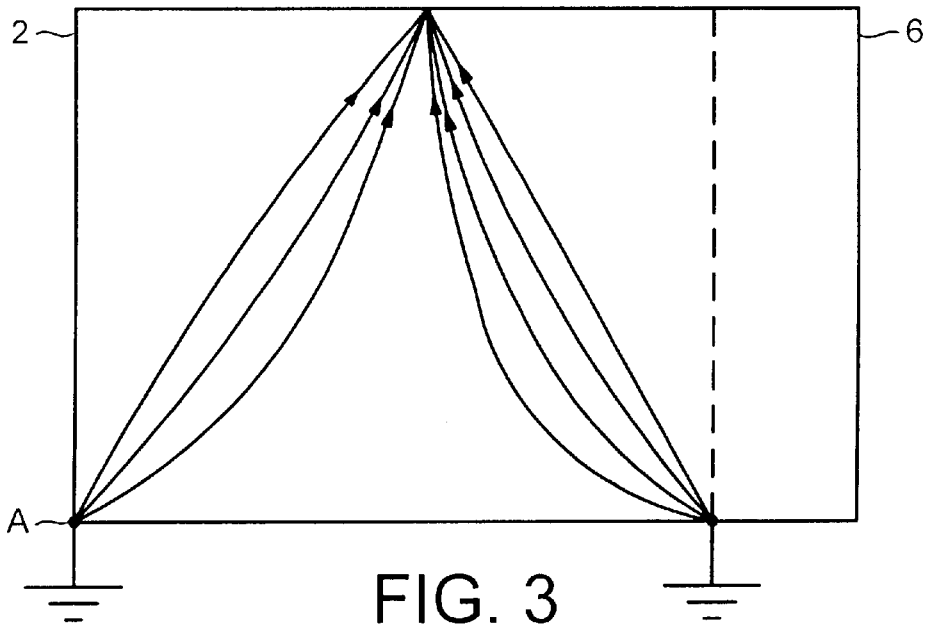
FIG. 3 illustrates the current flow for an antenna according to the present invention when operating at a second resonant frequency.

The second grounding point C acts as a secondary current source effectively altering the electrical length of the resonator element 2 and hence the resonant frequency. FIG. 3 shows a typical current flow when grounding point A acts as a first current source and the second grounding point C acts as a second current source.

The electrical length of the resonator element is determined, in part, by the distance between the grounding point A and C and will be shorter than the electrical length of resonator element 2 with a single grounding point.

The grounding point C is coupled to the resonator element 2 at a position to provide an electrical length that corresponds with the required second resonance frequency, for example 1795 MHz.

The first resonant frequency of the resonator element 2 can be tuned by varying the length of the resonator element 2, independently of the second resonant frequency. Correspondingly, the second resonance frequency of the resonator element 2 can be tuned by varying the position of the grounding point C, independently of the first resonant frequency.

Additionally, by using a filter 7 to couple the resonator element 2 to the ground plane 3 at a second grounding point the antenna 1 is able to operate at the first and second resonant frequencies simultaneously.

Figure 4:
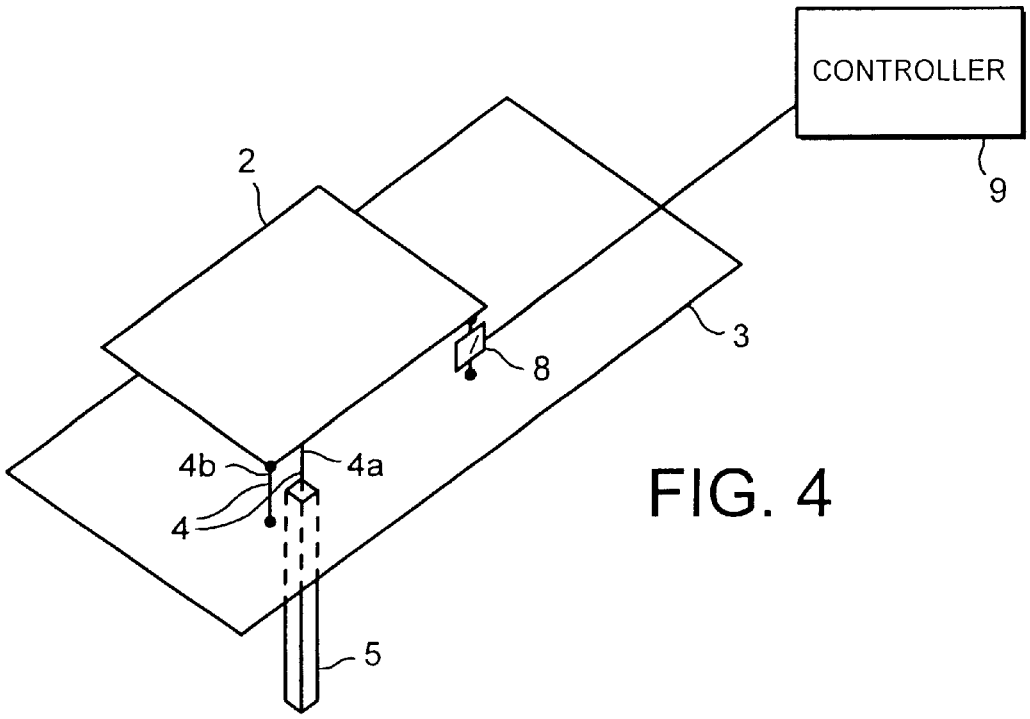
FIG. 4 shows an antenna according to a second embodiment of the present invention.

In a second embodiment, as shown in FIG. 4, the filter 7 is replaced by a switch 8 that is controlled by controller 9. When the switch 8 is in an open position (i.e. open circuit) the resonant frequency is determined, in part, by the length of the resonator element 2 with respect to the grounding point A. When the switch 8 is in a closed position (i.e. closed circuit) the resonant frequency is determined, in part, by the distance between the grounding points A and C in the same manner as described above. Examples of suitable switches are PIN diode, MOSFET, transistor and magnetic field switches.

The present invention may include any novel feature or combination of features disclosed herein either explicitly or implicitly or any generalisation thereof irrespective of whether or not it relates to the presently claimed invention or mitigates any or all of the problems addressed. In view of the foregoing description it will be evident to a person skilled in the art that various modifications may be made within the scope of the invention. The applicant hereby gives notice that new claims may be formulated to such features during prosecution of this application or of any such further application derived therefrom. For example, it will be appreciated that additional resonating frequencies can be created by including on the resonator element additional grounding points coupled to the ground plane via either a switch or filter. Further by varying the size of the grounding points on the resonator element the bandwidth of the resonant frequencies can be varied.

What is claimed is:

1. In an antenna having an electrical reference plane and a planar conductive element having a length and a width, a system for providing multiple resonant frequencies comprising:

a first coupling means for coupling said electrical reference plane to said planar conductive element at a position on said planar conductive element to define a first antenna resonant frequency;

a second coupling means for coupling said electrical reference plane to said planar conductive element at a position on said planar conductive element to define a second antenna resonant frequency, said second coupling providing a high impedance path between the electrical reference plane and the planar conductive element at the first resonant frequency and a lower impedance path between the electrical reference plane and the planar conductive element at said second resonant frequency; and wherein the first and second coupling means are spaced apart a distance, said distance being substantially the length of the planar conductive element and causing mutually deflecting currents to flow from each of the two coupling means to define said second resonant frequency.

2. The antenna according to claim 1, wherein the first coupling means defines a first electrical reference point on the planar conductive element.

3. The antenna according to claim 1, wherein the second coupling means defines a second electrical reference point on the planar conductive element when the second coupling means provides a lower impedance path between the electrical reference plane and the planar conductive element.

4. The antenna according to claim 1, further comprising a feed section for supplying a signal to the antenna.

5. The antenna according to claim 4, wherein the feed section comprises the first coupling means and a conducting element arranged parallel to each other with the conducting element being connected to a feed such that the first coupling means and the conducting element form a transmission line.

6. The antenna according claim 1, wherein the planar conductive element is disposed parallel to the electrical reference plane at a predetermined distance.

7. The antenna according claim 1, wherein the lower impedance is less than 5 ohms.

8. The antenna according claim 1, wherein the second coupling means comprises a filter.

9. The antenna according to any of claims 1, wherein the second coupling means comprises a switch movable between a first position for electrically isolating the electrical reference plane and planar conductive element and a second position for electrically coupling the electrical reference plane and planar conductive element.

10. The antenna, according to claim 1, adapted for operation with a mobile radiotelephone.

11. The antenna according to claim 1 adapted for operation with a portable radio device.

12. A method of providing multiple resonant frequencies for an antenna, said antenna having an electrical reference plane and a planar conductive element, said planar conductive element having a length and a width, said method comprising the steps of:

coupling said electrical reference plane to said planar conductive element at a first position on said planar conductive element to provide a first antenna resonant frequency;

coupling said electrical reference plane to said planar conductive element at a second position on said planar conductive element to provide a second antenna resonant frequency, said coupling at said second position providing a high impedance path between the electrical reference plane and the planar conductive element at the first resonant frequency and a lower impedance path between the electrical reference plane and the planar conductive element at said second resonant frequency; and wherein the first and second coupling means are spaced apart a distance , said distance being substantially the length of the planar conductive element and causing mutually deflecting currents to flow from each of the two coupling means, to define said second resonant frequency.

13. An antenna comprising an electrical reference plane; and a planar conductive element having a length and a width, the electrical reference plane and planar conductive element being electrically coupled via a first coupling means to define a first antenna resonant frequency; and a second coupling means comprising a filter constructed to provide a high impedance path between the electrical reference plane and the planar conductive element at the first resonant frequency and a lower impedance path between the electrical reference plane and planar conductive element at a second resonant frequency, wherein the first and second coupling means are spaced apart at a distance, said distance being substantially the length of the planar conductive element and causing mutually deflecting currents to flow from each of the two coupling means to define said second antenna resonant frequency.

* * * * *